US005947257A

United States Patent [19]

Schwartz

[11] Patent Number: 5,947,257

[45] Date of Patent: Sep. 7, 1999

[54] ELECTRONIC COIN COUNTER FOR CASHIER STATION

[76] Inventor: Melvin Schwartz, 117 Ocean Ave, Woodmere, N.Y. 11598-1440

[21] Appl. No.: 09/013,128

[22] Filed: Jan. 26, 1998

[51] Int. Cl.[6] ..... G07D 9/04; G07F 9/08

[52] U.S. Cl. ..... 194/224; 453/17; 453/32

[58] Field of Search ..... 453/17, 20, 21, 453/32, 58, 59, 61, 62, 63; 194/224

[56] References Cited

U.S. PATENT DOCUMENTS

| | | | |
|---|---|---|---|
| 2,732,923 | 1/1956 | Parker | 453/21 |
| 5,397,264 | 3/1995 | Gross | 453/62 X |
| 5,755,618 | 5/1998 | Mothwurf | 453/17 |

FOREIGN PATENT DOCUMENTS

| | | | |
|---|---|---|---|
| 2651105 | 5/1978 | Germany | 453/17 |
| 2658377 | 6/1978 | Germany | 194/224 |
| 573635 | 3/1976 | Switzerland | 453/17 |

*Primary Examiner*—F. J. Bartuska

[57] ABSTRACT

An electronic coin counter for use with cash register drawers. Coins are poured from the cash register drawer through openings in the top of a housing into sleeves that correspond to the denomination of the coins. Internal sensor tips are then brought into contact with the resulting column of coins by forcing a bar outside the housing in toward the housing. This activates a switch to supply electrical power to internal electronics and to external digital displays. The sensor tips are oriented in staggered pairs to prevent counting errors due to the presence of worn thin coins. Mathematical addition and multiplication necessary to obtain the monetary value of each denomination of coin and the total value of all the coins is performed automatically by internal logic circuitry. The monetary totals are then sent to the external digital displays while the coins are automatically ejected through holes in the bottom of the housing underneath each sleeve. A solenoid valve is actuated to temporarily remove a trap that otherwise prevents the coins from falling out of the sleeves. After a period of dormancy, internal timing circuitry automatically powers down the electronics.

7 Claims, 9 Drawing Sheets

ELECTRONIC COIN COUNTER FOR CASHIER STATION

BACKGROUND OF THE INVENTION

1. Field of the Invention

The present invention relates generally to coin counters and particularly to coin counters for use in totalling the monetary value of the coins in a cash register drawer.

2. Description of Related Art

When cashiers in a commercial establishment change shifts, go on breaks, or change cash registers, it is typically necessary for the outgoing cashier to total up the amount of money in their cash register drawer and for the incoming cashier to verify that total. At worst this process involves manually counting each coin in the cash register drawer twice, once by the outgoing cashier and once by the incoming cashier to verify. At best, customers are still made to wait for a somewhat lesser period of time or temporarily relocated to other lines when a cash drawer is being counted, causing delays in servicing customers. This situation causes stress for both customers and cashiers. Thus, there is a need for a compact portable device that will quickly and accurately total the amount of cash in a cash register drawer.

Devices addressing this problem are known. For example, U.S. Pat. No. 5,397,264, issued to Ira Gross on Mar. 14, 1995, discloses a cash drawer coin counter that rests on top of a cash register drawer during counting and deposits coins into compartments corresponding to denomination after counting. The invention described in Gross '264 returns coin to the compartments in the a cash register drawer with a single motion. Other patents disclosing devices designed to count coins in a cash register drawer include British Patent Numbers 2,038,064 and 2,224,142, published on Jul. 16, 1980 and Apr. 25, 1990 respectively.

Although known devices enable the counting and totalling of cash in a cash register drawer more quickly than if that cash were counted entirely by hand, the amount of time necessary to complete this procedure is still inconveniently long. Thus, there is a need for a coin counting device designed for use at cash registers that is faster than the previously known devices. Additionally, there are some practical considerations that known devices fail to address.

For example, as coins wear out, their thickness decreases. This causes reading errors in devices that utilize graduated columns. Since worn coins are thinner than new coins, devices that determine the number of coins in :a column based on the height of that column systematically underestimate the true number of coins in the column when the column contains a large number of well worn coins. Thus, there is a need for a coin counting device that will accurately count the number of coins in a stack regardless of whether those coins are freshly minted or well worn.

Further, devices that operate strictly on the basis of graduation marks are incapable of totalling the monetary value of all denominations of coins combined. Such devices require the additional time consuming step of manually adding up the monetary total of the various denominations of coins. In addition to the extra time involved in such a calculation, it also provides the opportunity for human error in arithmetic. Thus, there is a need for a coin counting device that automatically totals the individual totals.

Many known devices require coins to be manually replaced in their respective compartments after being counted. Such devices add yet another time consuming step in the process of a cashier change. Thus, there is a need for a cash drawer counting device that automatically deposits coins of various denominations back into their respective compartments after counting and totalling the contents of the cash drawer.

Other coin counting devices have different problems. For example, if pennies, nickels or dimes fall into a column of quarters, or pennies fall into a column of nickels, then those coins may be counted as quarters or nickels respectively, thus overcounting the cash in the drawer and shorting the incoming cashier. Conversely, if dimes fall into a column of pennies or nickels, then the dimes may be counted as pennies or nickels respectively, thus undercounting the cash in the drawer and shorting the outgoing cashier. In order to prevent such errors in devices that operate by graduated columns, each column must be visually inspected coin by coin prior to totalling the monetary value of the coinage. Without such a visual inspection coins of one denomination could be improperly counted as coins of another denomination. This visual inspection is time consuming and susceptible to human error. Thus, there is a need for a device that automatically detects errors in stacking coins of various denominations and alerts the user as to the presence of the error.

Devices designed for vending machines, coin sorters, or other change making machines are useful to show different types of coin sensors that are known. The following patents all show devices related to vending machines, coin sorters, or change making machines: U.S. Pat. Nos. 936,122, issued to Conrad A. Grimm on Oct. 5, 1909; U.S. Pat. Nos. 1,110,771, issued to James B. Grimes on Sep. 15,1914; 1,166,302 issued to Hyman Abramovitz on Dec. 28, 1915; U.S. Pat. No. 3,308,914, issued to Lelyn D. Lake on Mar. 14, 1967; U.S. Pat. No. 3,359,993, issued to Edward J. Tyron et al. on Dec. 26, 1967; U.S. Pat. No. 3,927,688, issued to Alfred Cohn et al. on Dec. 23, 1975; U.S. Pat. No. 4,040,434, issued to Kenkichi Watanabe et al. on Aug. 9, 1977; U.S. Pat. No. 4,199,669, issued to Carl L. Vogt on Apr. 22, 1980; U.S. Pat. No. 4,460,003, issued to Elwood E. Barnes et al. on Jul. 17, 1984; U.S. Pat. No. 4,491,140, issued to David Eglise et al. on Jan. 1, 1985; U.S. Pat. No. 4,587,984, issued Lo Joseph L. Levasseur et al. on May 13, 1986; U.S. Pat. No. 4,646,767, issued to Michiyasu Hikita on Mar. 3, 1987; U.S. Pat. No. 4,774,841, issued to Neville D. Chadwick on Oct. 4, 1988; U.S. Pat. No. 4,883,158, issued to Osamu Kobayashi et al. on Nov. 28, 1989; U.S. Pat. No. 5,052,538, issued to Naoto Satoh on Oct. 1, 1991; U.S. Pat. No. 5,092,816, issued to Joseph LT. Levasseur on Mar. 3, 1992; U.S. Pat. No. 5,380,242, issued to Sadao Matsumoto et al. on Jan. 10, 1995; and U.S. Pat. No. 5,499,944, issued to John A. Weston et al. on Mar. 19, 1996; British Patent Numbers 1,231,427, published on May 12, 1971; 1,373,135, published on Nov. 6, 1974; 2,154,352, published on Sep. 4, 1985; and 2,269,088, published on Feb. 2, 1994; and European Patent Numbers 189,429, published on May 17, 1985; 314,463, published on May 3, 1989; and 512,938, published on Nov. 11, 1992.

None of the above inventions arid patents, taken either singly or in combination, is seen to describe the instant invention as claimed.

SUMMARY OF THE INVENTION

The invention is an electronic coin counter for use with a cash register drawer. Coins are poured from the cash register drawer through openings in the top of a housing into sleeves that correspond to the denomination of the coins. Internal sensor tips are then inserted into slots in the sleeves by forcing a bar outside the housing in toward the housing. This activates a switch to supply electrical power to internal electronics and to external digital displays. The sensor tips are oriented in staggered pairs to prevent counting errors due to the presence of worn thin coins. Mathematical addition and multiplication necessary to obtain the monetary value of each denomination of coin and the total value of all the coins is performed automatically by internal logic circuitry. The monetary totals are then sent to the external digital displays while the coins are automatically ejected through holes in the bottom of the housing underneath each sleeve upon actuation of a solenoid valve which temporarily opens a trap that otherwise prevents the coins from falling out of the sleeves. After a period of dormancy, internal timing circuitry automatically powers down the electronics.

Accordingly, it is a principal object of the invention to reduce the amount of time taken to count and total the value of all coins in a cash register drawer and to redistribute the coins into the appropriate compartments of the cash register drawer.

It is another object of the invention to accurately count the number of coins in a stack of coins regardless of the wear condition of coins and to automatically total the individual totals of different denominations of coins without manual arithmetic.

Still another object of the invention is to automatically deposit coins of various denominations back in their respective compartments after counting and totalling the contents of a cash register drawer.

Yet another object of the invention is to automatically detect errors in stacking coins of various denominations and to alert a user as to the presence of the error.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a portable electronic coin counter 20 for automatically counting and totalling the value of a large number of coins.

Figure 1:
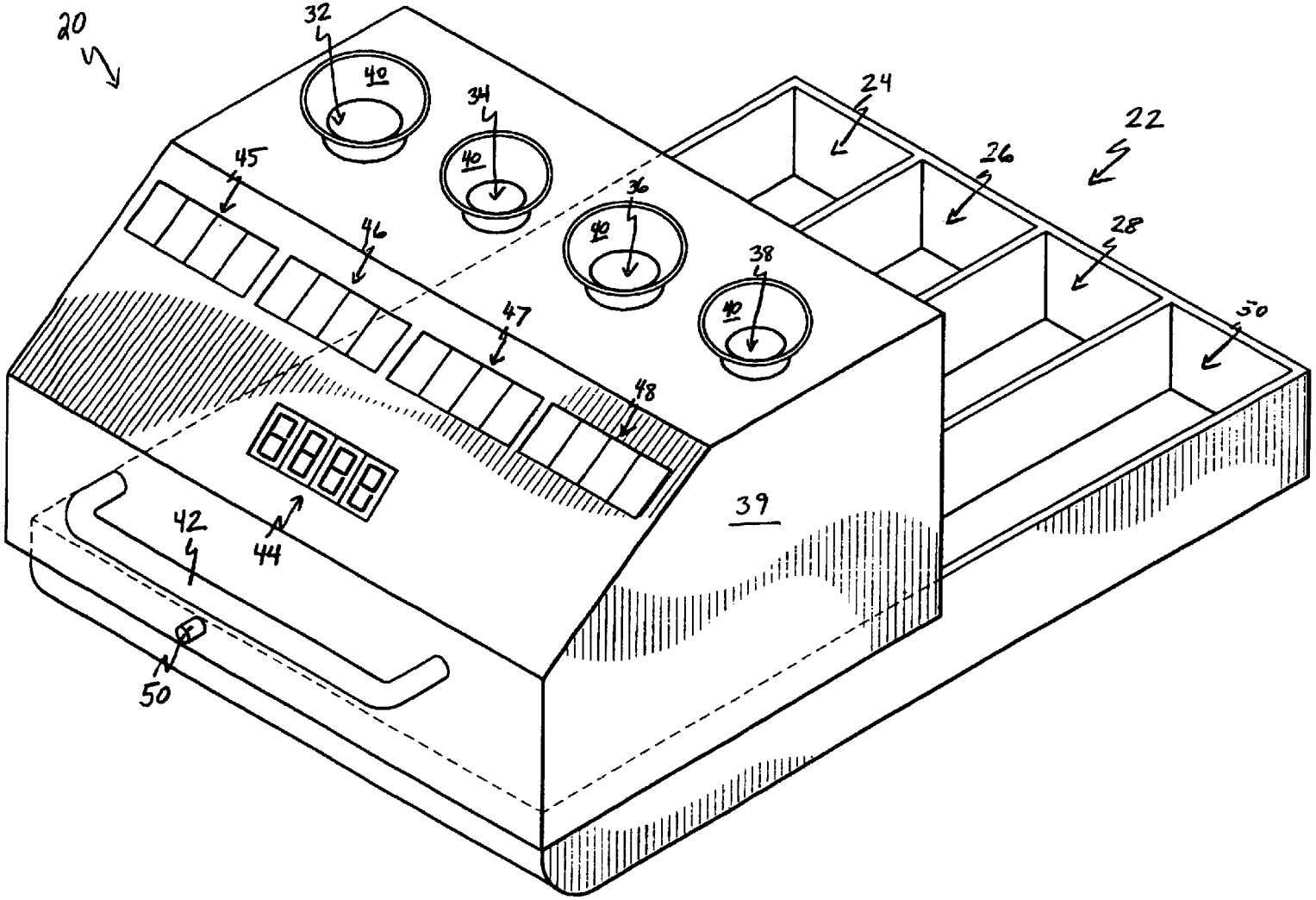
FIG. 1 is an environmental perspective view of the invention seated upon a cash register drawer.

Referring to FIG. 1, an electronic coin counter 20 is shown resting upon a cash register drawer 22. The electronic coin counter 20 has a housing 39. The housing 39 extends beyond each edge of the cash register drawer 22 to secure the electronic coin counter 20 in place atop the cash register drawer 22. The counter 20 is positioned over the cash register drawer 22 to deposit coins of each discrete denomination into separate compartments 24-30 of the cash drawer 22 in a single action after counting and totalling the value of those coins. The electronic coin counter 20 is portable and thus movable from one cash register drawer 22 to another and enables the counter 20 be stored in a safe and secure location, such as a manager's office, when not in use.

As noted, the cash register drawer 22 has compartments 24-30 for coins of different denominations, such as a quarter compartment 24, a dime compartment 26, a nickel compartment 28, and a penny compartment 30. It should be apparent that these denominations will be altered for different monetary systems of coinage. Above each of the four compartments 24-30, the coin counter 20 has a quarter sleeve 32, a dime sleeve 34, a nickel sleeve 36, and a penny sleeve 38 respectively. Each sleeve 32-38 is centered above the compartment 24-30 corresponding to the same denomination of coin contained in the sleeve 32-38.

Each sleeve 32-38 is open ended at the top and bottom. At the top of each sleeve 32-38 is a flare 40. the flare 40 is funnel shaped to help guide coins into the sleeves 32-38 through an opening in a housing 39. The electronic coin counter 20 is operated by gathering the coins from one of the compartments 24-30 at a time and feeding the coins of that denomination into the corresponding sleeve 32-38 through the flare 40, thereby forming a column of coins 41. When all coins from the cash register drawer 22 are placed into one of sleeves 32-38 of the electronic coin counter 20, a sensor bar 42 is manually depressed inward toward the front of the housing 39.

When the sensor bar 42 is depressed inward, an internal switch is activated to supply power to internal electronics (discussed later) and to a total display 44 (shown in FIG. 1). The total display 44 indicates the total value of the coins of the counted sleeves 32-38. Upon activation of the internal switch, power is also supplied to a quarter display 45, a dime display 46, a nickel display 47, and a penny display 48, each generally designated in FIG. 10 by the term "display". These displays 45-48 show the total monetary value of the coin column, 41 contained in the quarter sleeve 32, the dime sleeve 34, the nickel sleeve 36, and the penny sleeve 38, respectively. In the preferred embodiment, the displays 44-48 are all common LED indicators with four characters, each character displaying a single digit number between zero and nine. A decimal point which separates the dollars from the cents between the second and third character in the displays 44-48 is also provided. The total monetary value of the coins in a cash register drawer 22 rarely exceeds $100 U.S. Therefore, the preferred embodiment does not contain a fifth character in the displays 44-48.

During counting, only one display is illuminated at one moment in time. However, a display control switch 50 is positioned underneath the sensor bar 42 so that each time the display control switch 50 is depressed, each display 44-48 is illuminated in sequence through the following clockwise toggle sequence: total display 44, quarter display 45, dime display 46, nickel display 47, penny display 48, and back to total display 44. This toggle sequence is repeated until the display control switch 50 is deactivated.

Figure 2:
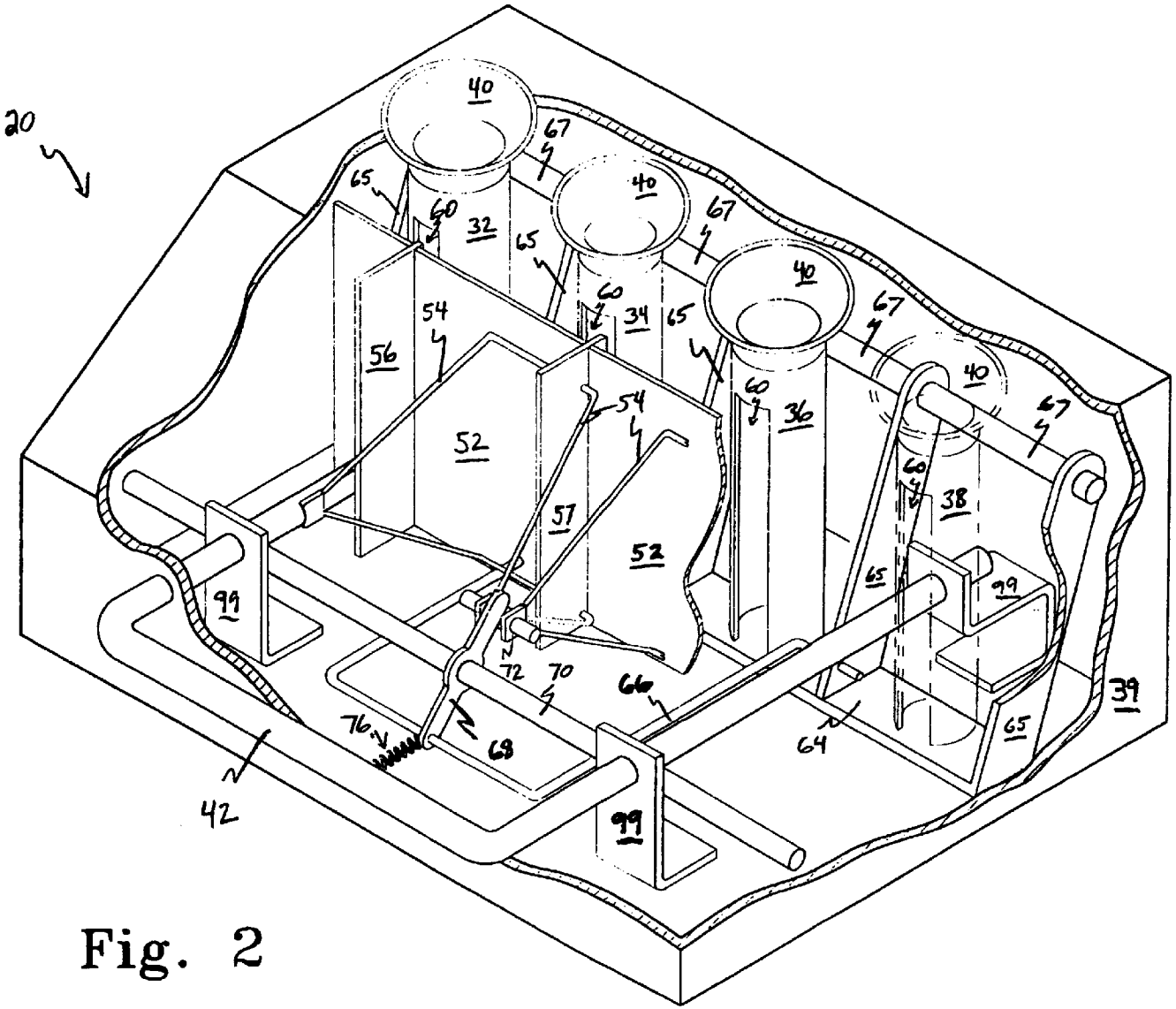
FIG. 2 is a fragmented, perspective view showing partially offset, sectioned internal elements of the invention while in a state of rest.

Referring to FIG. 2, brackets 99 at both the front: and rear of the housing 39 support the sensor bar 42 which passes through an aperture in each bracket, allowing portion of the sensor bar external to the housing to be depressed and reciprocally slid forward. The internal portion of the sensor bar 42 is securely attached to a sensor support panel 52 by a series of support bars 54. The sensor support panel 52 and support bars 54 stabilize a quarter sensor array 56, a dime sensor array 57, a nickel sensor array 58, and a penny sensor array 59. Each of the coin sleeves 32-38 has a slot 60. When the sensor bar 42 is pushed inward, the end of each array 56-59 moves forward into a slot 60. If there is a column of coins 41 in a sleeve 32-38, the end of the array 56-59 will come into contact with the column of coins 41, thus defining the coin counting position.

Figure 4:
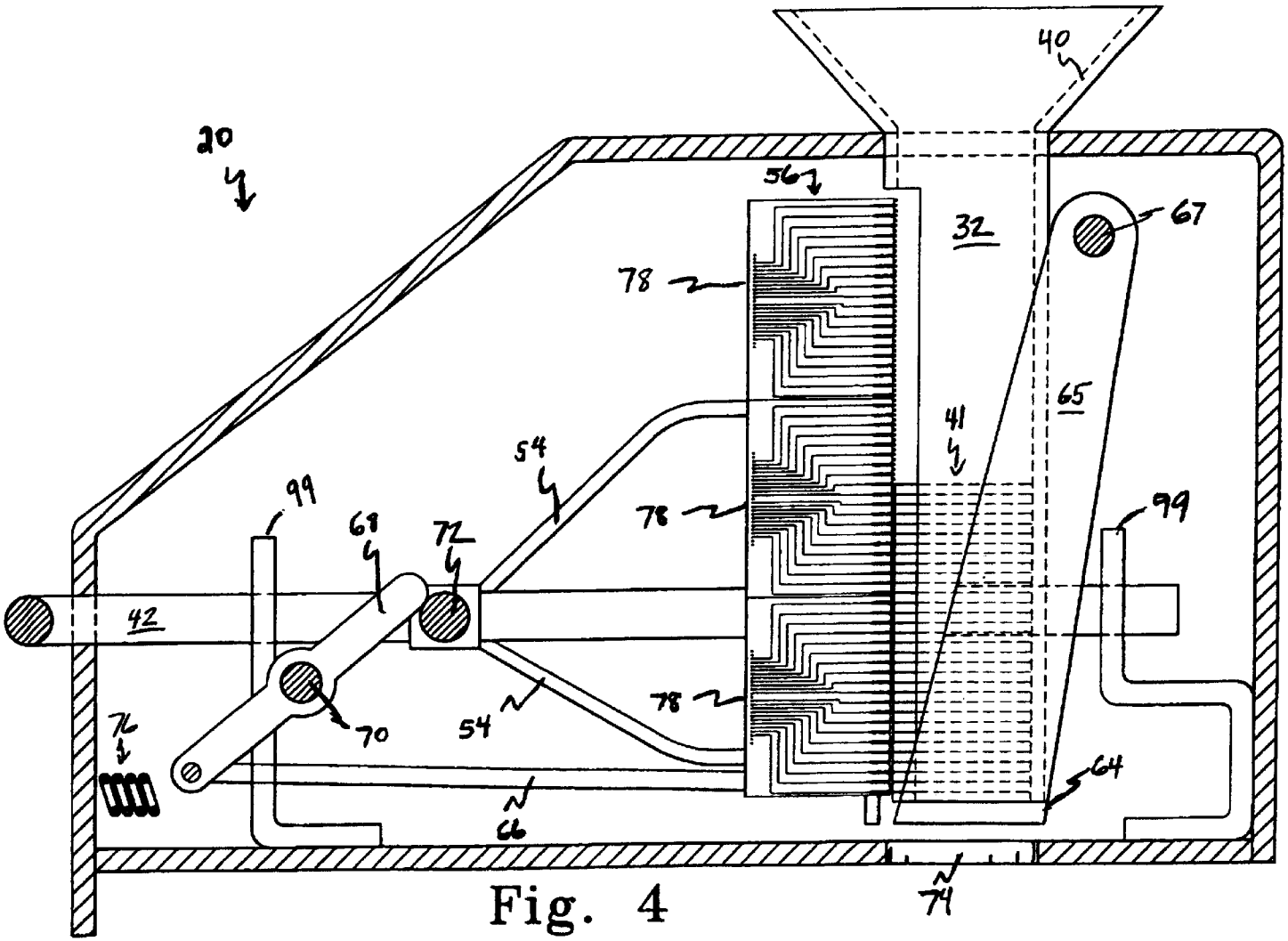
FIG. 4 is an offset sectional side view showing the invention in a state of counting coins.

FIG. 4 shows an embodiment of the electronic coin counter 20 in the coin counting position. The edge of the quarter sensor array 56 and the column of coins 41 are in contact. Similarly, the other sensor arrays 57-59 are in contact with the column of coins 41 in the other sleeves 34-38 when the electronic coin counter 20 is in the coin counting position.

Figure 3:
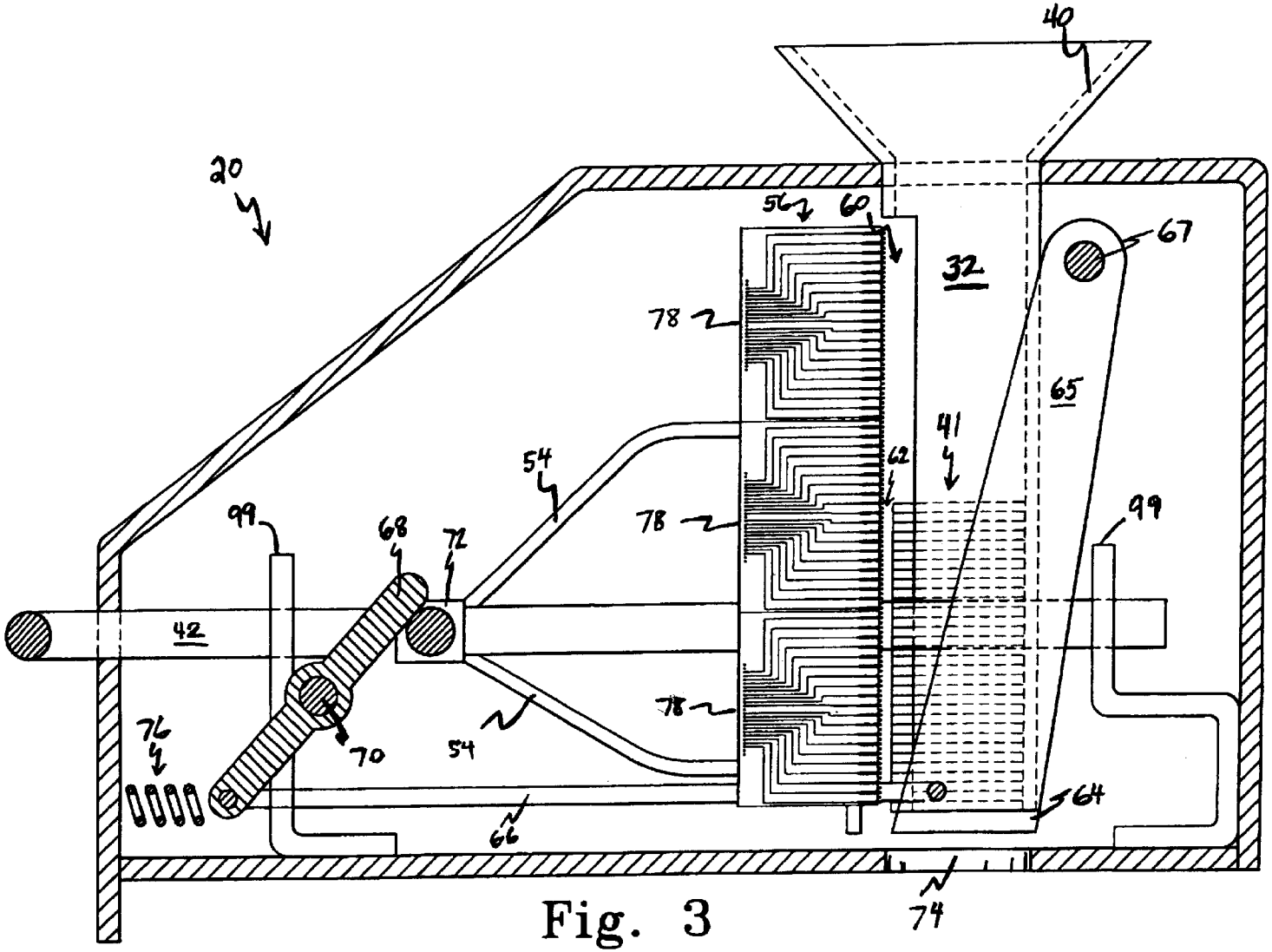
FIG. 3 is an offset sectional side view showing internal elements of the invention while in a state of rest.
Figure 5:
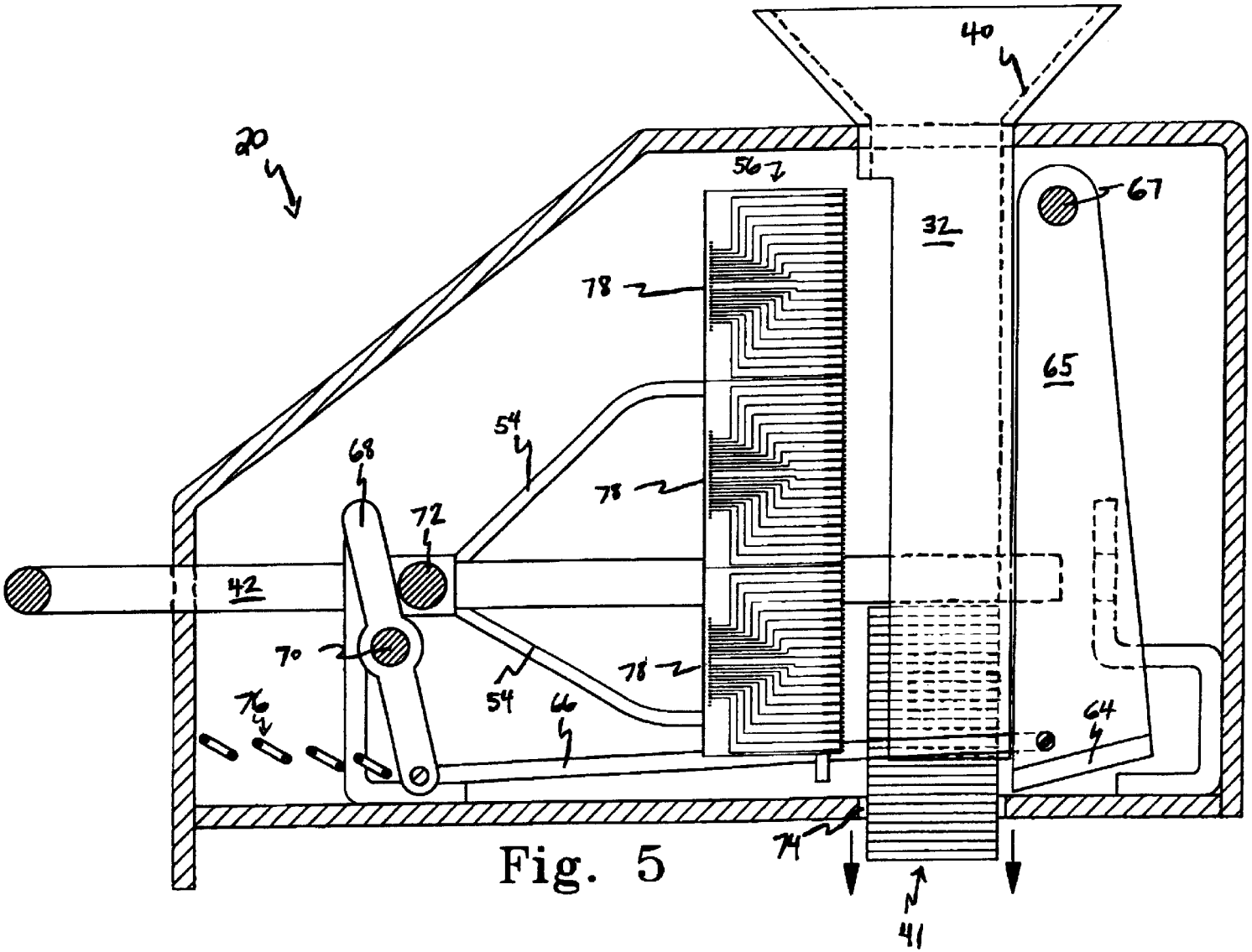
FIG. 5 is an offset sectional side view showing the invention in a state of releasing coins.

FIGS. 3 to 5 show a coin trap door 64 to which a trap release rod 66 is securely fastened. The coin trap door 64 spans the bottoms of all the coin sleeves 32-38 and thereby prevents the column of coins 41 from falling out of the open bottoms of sleeves 32-38 when the electronic coin counter 20 is in the coin counting position as shown in FIGS. 3 and 4. The coin trap 64 door is attached by coin trap supports 65 to a trap dowel 67 which passes through coin trap supports 65 near the top of the electronic coin counter 20. The trap dowel 67 is a pivot about which the trap door assembly rotates to release the coins by removing the trap door 64 from beneath the column of coins 41.

The trap release 66 is attached to both the support 65 and the lower end of a pivot arm 68. A pivot arm dowel 70 runs through an eye in the center of the pivot 68. The pivot arm dowel 70 is secured to the inside of the side walls of the housing 39 and forms an axis around which the pivot arm 68 rotates. The sensor bar 42 is securely fastened to the upper end of the pivot arm 68 by a retaining bracket 72. Thus, when the sensor bar 42 is pulled rearward, away from the front of the housing 39 as shown in FIG. 5, the pivot arm 68 rotates counter-clockwise around the pivot arm dowel 70 forcing the trap release rod 66 forward. As the trap release rod 66 is forced forward, the coin trap door 64 rotates counter-clockwise around the trap dowel 67 by virtue of the coin trap supports 65, thus exposing the opening in the bottom of the coin sleeves 32-38. When the opening in the bottom of the coin sleeves 32-38 is exposed, the column of coins 41 is able to fall out of the bottom of the housing 39 by passing through a hole 74 in the housing 39 in registry with the coin sleeves 32-38. The hole 74 must have a diameter larger than the diameter of the coins associated with a column of coins 41 so that the column of coins 41 may exit the housing 39 by falling through the hole 74. When the coin trap 64 is no longer supporting the column of coins 41, then the electronic coin counter 20 is in the coin release position, as shown in FIG. 5.

To urge the internal components of the electronic coin counter 20 out of the release position after each column of coins 41 passes out of the housing 39, a spring 76 is attached to the bottom rear of the pivot 68 and to the inside of the front of the housing 39. When the spring 76 is at equilibrium, there is a gap 62 between the edge of the quarter sensor array 56 and the column of coins 41 in the quarter sleeve 32. Likewise; when the spring is at equilibrium, there is a gap between the sensor arrays 57-59 and the column of coins 41 in the sleeves 34-38 not shown. When the spring is at equilibrium and there is a gap between the sensor arrays 56-59, a resting position is defined. The coin trap door 64 remains in position to prevent the column of coins 41 from falling out of the sleeve 32-38 when the electronic coin counter 20 is in the coin counting position.

Activation of the internal switch also supplies electrical power to a pair of solenoid valves (not shown). The first solenoid valve is energized immediately upon receipt of power from the internal power switch. This first solenoid holds the internal components of the electrical coin counter 20 in the coin counting position against the resistance of the compressed spring 76. Thus, the electronic coin counter 20 remains in the coin counting position when the hand that depressed the sensor bar 42 is removed from the sensor bar 42.

After the total value of the coins is determined, the first solenoid is de-energized and the second solenoid is energized forcing the sensor bar 42 back away from the housing 39, through and then beyond the resting position. This motion releases all of the coins in the sleeves 32-38 so that the coins drop from the bottom of the housing 39 back into the compartment 24-30 from which they came before they were loaded into the sleeves 32-38. In an alternative embodiment, a double acting solenoid valve is used in place of the two single acting solenoid valves.

Figure 6:
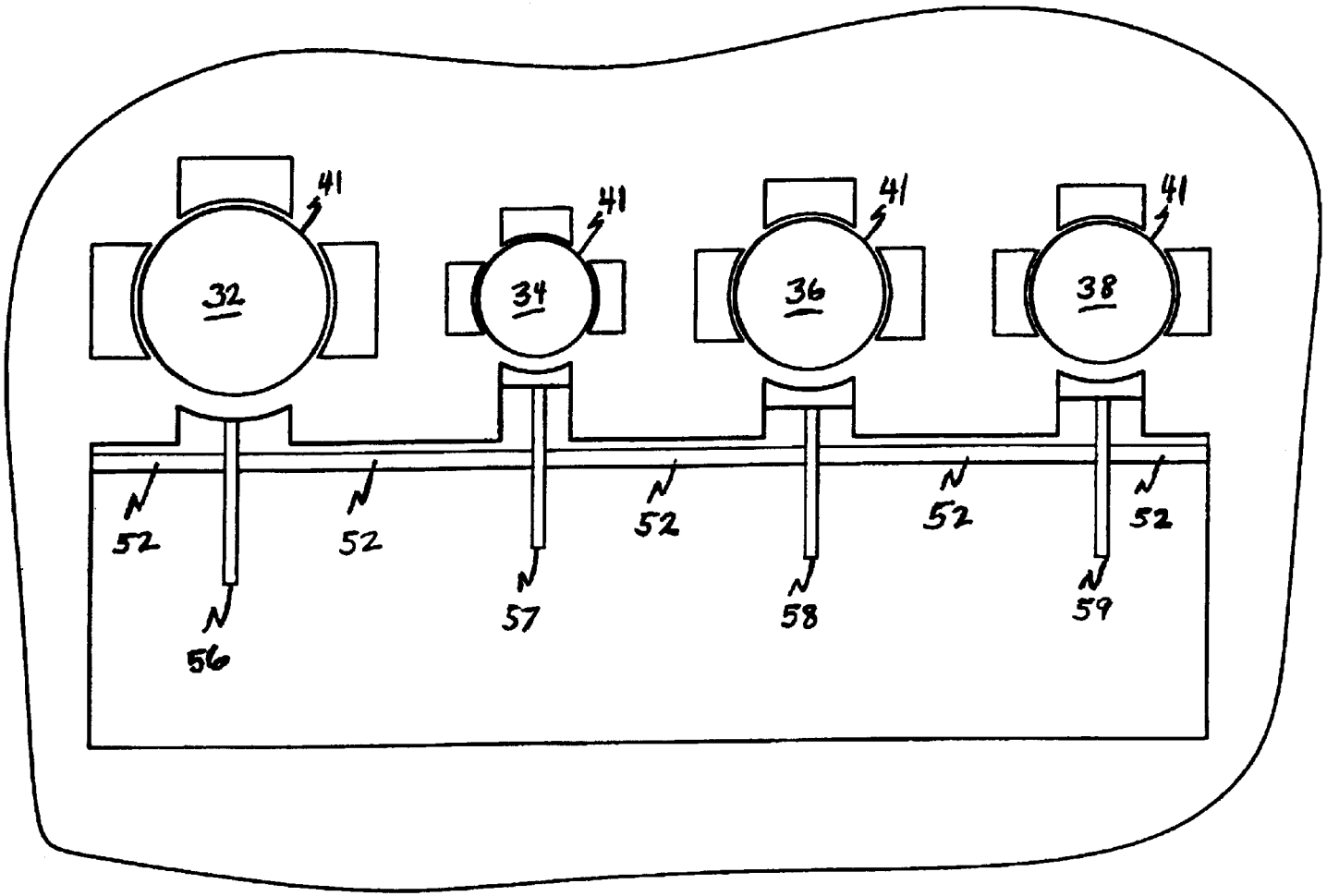
FIG. 6 is a fragmented top view showing details of the sensor arrays and support panels while the invention is in a state of at rest.

For aesthetic reasons, the centers of the sleeves 32-38 form a line in the preferred embodiment. However, because the diameter varies in each different denomination of coin, aligning the centers of the sleeves 32-38 requires the sensor arrays 56-59 to extend in front of the sensor support panel 52 by distances that are unequal. FIG. 6 shows that the dime sensor array 57 extends in front of the sensor,support panel by the largest distance and that the quarter sensor array 56 extends in front of the sensor support panel 52 by the shortest distance. This is true because a dime has the smallest diameter and a quarter has the largest diameter of the coin denominations used in the U.S.

Figure 7:
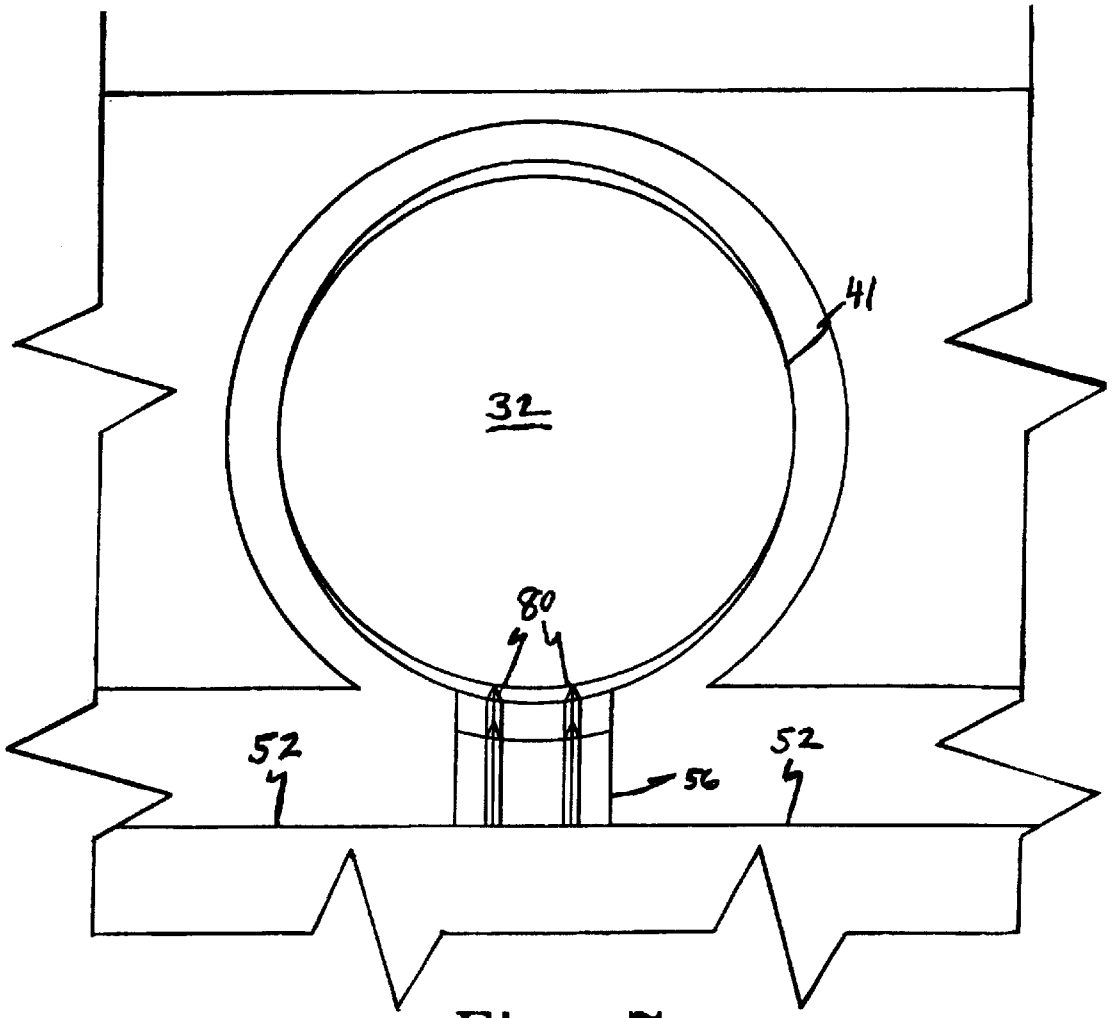
FIG. 7 is a fragmented detail top view showing coin sensors in contact with a coin column.

It is important that the relative orientation of the sensor arrays 56-59 and the sensor support panel 52 be designed so that the end of the sensor arrays 56-59 will come into contact with each column of coins 41 present in a sleeve 32-38 simultaneously. As a less aesthetically pleasing alternative to the design shown, the electronic coin counter 20 is designed with the ends of the sensor arrays 56-59 in a straight line. In this alternative design the centers of the sleeves 32-38 would not form a line. Referring to FIG. 7, greater detail is shown in a top view of the end of the quarter sensor array 56.

Figure 9:
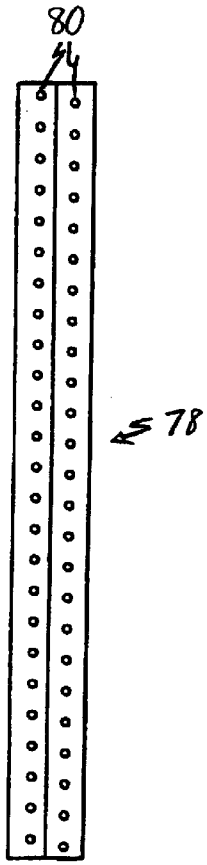
FIG. 9 is an end view of a coin sensor breadboard folded.
Figure 8:
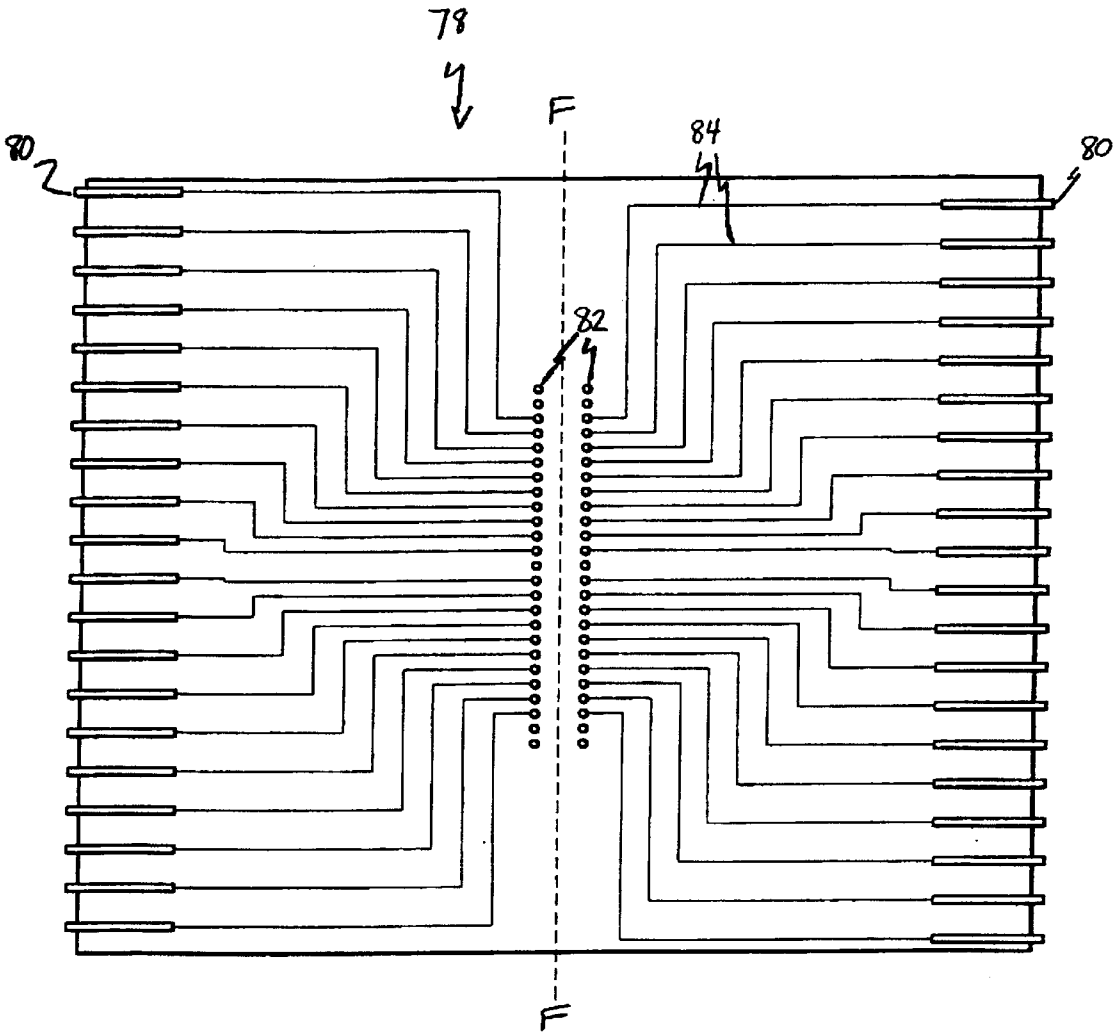
FIG. 8 is a section side view showing a coin sensor breadboard assembly unfolded.

FIG. 8 shows detail of a sensor breadboard 78 prior to installation in a sensor array 56-59. Sensor tips 80 protrude from the ends of the sensor breadboard 78. Each sensor tip 80 is connected to a pin 82 through an electrical conduit 84. When installed in a sensor array 56-59, each sensor breadboard 78 is folded along fold line F—F. Thus, when folded and installed, each sensor breadboard appears as shown in FIG. 9 when viewed from the edge of the sensor tips 80.

The separation between the center of the sensor tips 80 in the sensor breadboard 78 should be equal to the thickness of the type of coin those sensor tips 80 are intended to detect. For quarters a separation of thirteen one-hundredths of an inch is recommended; for dimes, ten one-hundredths of an inch; for nickels, fourteen one-hundredths; and for pennies, eleven one-hundredths of an inch is recommended. In systems using other denominations of coins, the distance between the center of the sensor tips should be varied to correspond to the thickness of those coins.

A common spring tip or pin is the preferred design for the sensor tip 80. FIG. 7 shows detail of this preferred embodiment. Alternative designs include well-known inductors, light beams and photo-cells, micro-switches, or even the less well-known use of radar, sonar, or the Hall effect.

Figure 10:
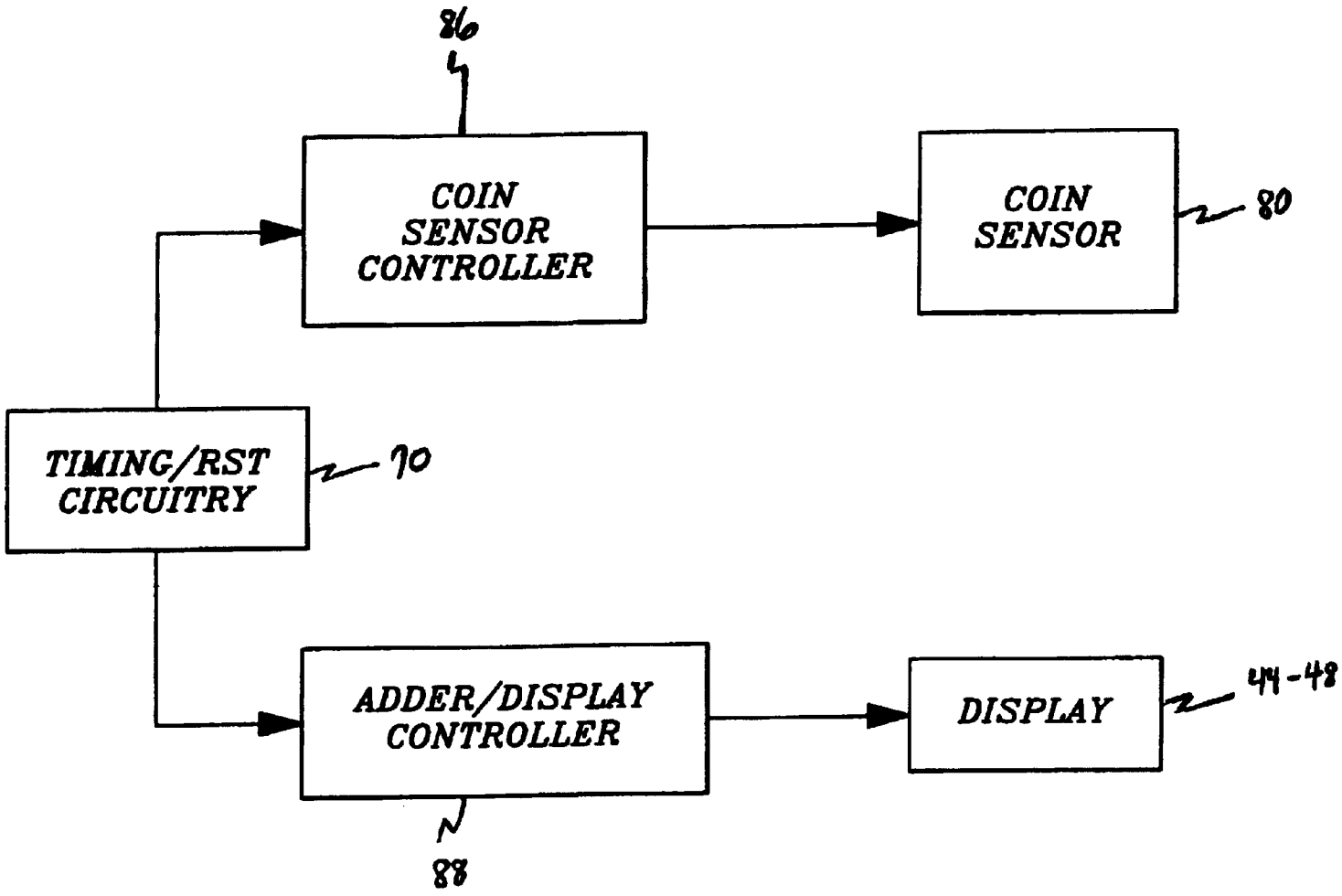
FIG. 10 is a logic diagram of the operation of the invention.

Referring to FIG. 10, the electronics are shown in the form of a logic diagram. When the sensor bar 42 is pushed forward and the internal electronics activated with the sensor arrays 56-59 each in contact with a column of coins 41, a coin sensor controller 86 starts sequencing through the sensor tips 80 from the top of the sensor array 56-59 injecting a digital pulse to the sensor tips 80 one at a time. There is one coin sensor controller 86 for each denomination of coin being measured. In the preferred embodiment there are four coin sensor controllers 86, one for quarters, one for dimes, one for nickels, and one for pennies. The coin sensor controllers 86 run in parallel.

An adder/display controller 88 monitors a coin sensor return line (not shown) for the presence of the digital pulse injected to the sensor tips 80. A total coin count is stored for each sensor tip 80 in contact with a coin. If any sensor tip 80 between the first sensor tip 80 in a sensor array 56-59 to detect the presence of a coin and the last sensor tip 80 at the bottom of the sensor array 56-59 does not detect the presence of a coin, then an error message is sent to the total display 44 and to the display 45-48 of the denomination for which the error was detected. Error messages will be sent if a dime, nickel, or penny is in the quarter sleeve 32, if a dime or penny are in the. nickel sleeve 36, and if a dime is in the penny sleeve 38. Error messages will also be sent if a coin is standing on edge within a sleeve 32-38. In all of these conditions, a sensor tip 80 designed to come in contact with a coin of the proper denomination for that sleeve 32-38 will not come in contact with any coin.

In the preferred embodiment, the error message will read 88.88 in the total display 44 as shown in FIG. 1. Alternatively, the error message will read "ERR", or some other combination of characters predetermined to designate the presence of an error in the sequencing of a coin sensor controller 86 through the sensor tips 80 in contact with a column of coins 41.

When each coin sensor controller 86 completes sequencing through the sensor tips. 80, a ready signal is activated and transmitted to the adder/display controller 88, After the adder/display controller receives a ready signal from each coin sensor controller 86, it polls the coin sensor controllers 86 for the number of coins detected. Then, an adder function within the adder/display controller 88 assigns a monetary value to each coin count based on which coin sensor controller 86 sent the coin count to the adder/display controller 88. After the monetary totals are calculated, a second ready signal is sent to the total display 44. This second ready signal alerts an observer that the electronic coin counter 20 is prepared to display the monetary totals of the coins contained in the sleeves 32-38.

As shown in FIG. 9, the sensor tips 80 are oriented in staggered pairs. This arrangement eliminates counting errors due to the presence of old thin coins in a sleeve 32-38. If either of the sensor tips 80 in a staggered pair Indicate the presence of a coin, then the adder/display controller 88 will count one coin for that location. Thus, even if the column of coins 41 is shorter due to thin old coins, one sensor tip 80 will still indicate the presence of a coin enabling the adder/display controller 88 to correctly count the number of coins in a column of coins 41.

Each sensor array 56-59 is formulated from a plurality of sensor breadboards 78 stacked edge to edge on top of one another, as shown in FIGS. 3 to 5. The pins 82 that are connected to sensor tips 80 by electrical conduits 84 in the sensor breadboard 78 are also electrically connected to the coin sensor controller 86. Other pins 82 are connected to ground, etc. as commonly understood by those in the art as necessary to the operation of electrical circuitry breadboards in general.

In the preferred embodiment power to the electronic coin counter 20 is supplied by a common nine volt battery (not shown). The internal electronics include timing/rst circuitry 90. The timing/rst circuitry 90 shuts off power to the displays 44-48 when more than thirty seconds has passed since the display control switch 50 has been depressed. This prevents the battery from wearing out as it might if a manual power-off switch was inadvertently neglected. At the same time, the second solenoid is de-energized. Thus, with the solenoids both de-energized and the power off, the spring 76 urges the internal components of the electronic coin counter 20 into the resting position.

It is to be understood that the present invention is not limited to the sole embodiment described above, but encompasses any and all embodiments within the scope of the following claims.

I claim:

1. An electronic coin counter for counting the number of and totalling the monetary value of coins contained in a cash register drawer, the electronic coin counter comprising:

a. a housing having a front, a rear, a bottom defining a hole, a top defining an opening, and a lip extending beyond the bottom of the housing for stabilizing the housing when the housing is atop another object, b. a tubular coin sleeve extending vertically down from the opening defined by the top of the housing, the coin sleeve defining an opening at its bottom aligned vertically in registry with the hole in the bottom of the housing, and defining a slot in its side, and having a diameter equivalent to the diameter of a predetermined denomination of coin, c. a flare extending upwardly and outwardly from the opening defined by the top of the housing, d. a sensor bar protruding from the front of the housing and extending within the housing and being slidably attached to the housing, the sensor bar having a resting position, a coin counting position wherein the sensor bar is closer to the housing than in the resting position, and a coin release position wherein the sensor bar is further from the housing than in the resting position, e. a trap blocking the opening at the bottom of the coin sleeve when the sensor bar is in the resting position and in the coin counting position and exposing the opening at the bottom of the coin sleeve when the sensor bar is in the coin release position so that any coins in the sleeve fall out of the sleeve and pass through the hole in the bottom of the housing when the sensor bar is in the coin release position, f. a sensor array being stabilized by a support means and being fixably connected to the sensor bar, the sensor array fitting into the slot in the sleeve when the sensor bar is pushed forward in the coin counting position, g. a series of pairs of sensor tips at the edge of the sensor array closest to the sleeve, the pairs of sensor tips being spaced apart by a distance equal to the thickness of the predetermined denomination of coin and indicating the presence of a coin, h. a digital electronic display in the housing that may be viewed from without the housing, the digital electronic display having four light emitting diode characters and displaying the total monetary value of any coins contained in the sleeve when the sensor bar is in the coin release position, and i. a display control switch protruding from the front of the housing, the display control switch actuating the digital electronic display.

2. The electronic coin counter according to claim 1 further comprising:

a pair of solenoid valves, the first solenoid valve holding the sensor bar in the coin count position when energized and the second solenoid valve holding the sensor bar in the coin release position when energized.

3. The electronic coin counter according to claims 1 further comprising:

a double acting solenoid valve holding the sensor bar in the coin count position and in the coin release position.

4. The electronic coin counter according to claim 2, further comprising:

a. a power on switch supplying electronic power to the sensor tips, the digital electronic display, and the solenoid valves when the sensor bar is actuated, and b. a timer shutting off power to the sensor tips, the digital electronic display, and the solenoid valves when the display control switch has been dormant with the sensor bar in the coin release position for a predetermined length of time.

5. The electronic coin counter according to claim 1 further comprising:

a. a coin sleeve having a diameter at least one-hundredth of an inch larger than a U.S. quarter, b. a coin sleeve having a diameter at least one-hundredth of an inch larger than a U.S. dime, c. a coin sleeve having a diameter at least one-hundredth of an inch larger than a U.S. nickel, d. a coin sleeve having a diameter at least one-hundredth of an inch larger than a U.S. penny.

6. A method of counting and totalling the number of and monetary value of coins contained in a cash register drawer the method comprising the steps of:

a. placing coins from the cash register drawer in tubular sleeves corresponding to the denomination of the coin forming a column of coins, b. inserting an array of sensor tips capable of detecting the presence of a coin into a slot in each sleeve, the sensor tips being arranged in staggered pairs, the staggered pairs being separated by the thickness of the denomination of the coin being detected, c. automatically electronically counting and totalling the monetary value of each discrete column of coins, d. automatically electronically adding and totalling the monetary value of all of the columns of coins combined, e. displaying the monetary value of all of the columns of coins combined, and f. releasing the coins from the sleeves and returning the coins to the cash register drawer in one motion.

7. The method of counting and totalling the number of and monetary value of coins contained in a cash register drawer described in claim 6, the method further comprising the step of displaying the monetary value of each discreet column of coins.

* * * * *